US005835994A

United States Patent [19]

Adams

[11] Patent Number: 5,835,994

[45] Date of Patent: Nov. 10, 1998

[54] CASCODE CURRENT MIRROR WITH INCREASED OUTPUT VOLTAGE SWING

[76] Inventor: William John Adams, 14931 Laurelgrove Cir., Irvine, Calif. 92714

[21] Appl. No.: 269,928

[22] Filed: Jun. 30, 1994

[51] Int. Cl.[6] ..... G05F 3/16

[52] U.S. Cl. ..... 323/315; 323/316

[58] Field of Search ..... 323/313, 314, 323/315, 316, 317

[56] References Cited

U.S. PATENT DOCUMENTS

| | | | |
|---|---|---|---|
| 4,008,441 | 2/1977 | Schade, Jr. | 330/288 |
| 4,327,321 | 4/1982 | Suzuki et al. | 323/315 |
| 4,362,984 | 12/1982 | Holland | 323/313 |
| 4,983,929 | 1/1991 | Real et al. | 330/288 |
| 5,252,910 | 10/1993 | Agaesse | 323/315 |

OTHER PUBLICATIONS

Analysis & Design of Analog Integrated Circuits, Second Edition, Gray et al, © 1984, 709–718.

A Programmable Gain/Loss Circuit, Babaneyhad et al, © 1987, IEEE, vol. SC–22, #6 Dec. 1987, pp. 1082–1090.

*Primary Examiner*—Peter S. Wong
*Assistant Examiner*—Shawn Riley

[57] ABSTRACT

A current mirror employs a voltage drop means in the input current path to set the voltage difference between the gates of the mirror driving FET and the mirror cascode FET. In cases where the voltage difference is chosen to be less than the voltage drop across a diode-connected FET, the current mirror will permit an increased output voltage swing relative to that permitted by a prior art cascode current mirror.

10 Claims, 11 Drawing Sheets

CASCODE CURRENT MIRROR WITH INCREASED OUTPUT VOLTAGE SWING

TECHNICAL FIELD

This invention relates to transistor current mirrors, and more particularly to current mirrors which allow an increased output voltage swing while maintaining a high output resistance.

BACKGROUND OF THE INVENTION

Current mirrors are basic building blocks of electronic circuit design. Desirable features of these blocks include a high output resistance and a high output voltage swing; i.e., it is desirable that the output resistance of the mirror remain high for a wide range of voltages which may appear at the output node. Another desirable feature is a high current transfer ratio accuracy, i.e., a high degree of matching between the actual ratio of the output current to the input current and the nominal ratio.

FIG. 1 shows a prior art simple current mirror. The output resistance of this mirror may be expressed as $$R_{outsimple}=r_{o2} \tag{1}$$

i.e., the output resistance of the simple mirror is equal to the output resistance of the output transistor M2. In practice, the output resistance of this simple mirror is often found to be insufficient. Also, the accuracy of the current transfer ratio is often found to be unacceptably poor for the case where the voltage at the output node (i.e., the drain-to-source voltage across the output transistor) is not equal to the drain-to-source voltage across the input transistor.

To obtain an increased output resistance, the prior art cascode current mirror of FIG. 2 is often used. The output resistance of the cascode current mirror may be expressed as $$R_{outcascode}=g_{m4}r_{o4}r_{o2} \tag{2}$$

where $g_{mi}$ and $r_{oi}$ are the transconductance and the output resistance of the ith transistor, respectively. Note from (1) and (2) that for the case where $r_{o2}$ of the simple mirror is equal to $r_{o2}$ of the cascode mirror and where the factor $g_{m4}r_{o4}$ exceeds unity, the output resistance of the cascode current mirror is indeed greater than that of the simple current mirror by a factor of $g_{m4}r_{o4}$. In practice, if transistor M4 of the cascode current mirror operates in the saturation region (i.e., with $V_{DS4} \geqq V_{GS4}-V_{T4}$, where $V_{DSi}$, $V_{GSi}$, and $V_{Ti}$ are the drain-to-source, gate-to-source, and threshold voltages, respectively, of the ith transistor), values of $g_{m4}r_{o4}$ greater than 100 can readily be achieved. The value of output resistance so obtained for the cascode current mirror is sufficiently high for many applications. In addition, the cascode devices M3 and M4 work to keep approximately the same drain-to-source voltages across the driving devices M1 and M2 regardless of the voltage at the mirror output node; hence, the current transfer ratio accuracy of the cascode mirror is greatly improved relative to that of the simple mirror.

A disadvantage of the cascode current mirror is the reduced output voltage swing as compared to that of the simple current mirror. Note that the voltage at the output of the cascode mirror is equal to the sum of the two drain-to-source voltages of the output transistors, $$V_{outcascode}=V_{DS2}+V_{DS4} \tag{3}$$

while the voltage at the output of the simple current mirror is equal to a single drain-to-source voltage $$V_{outsimple}=V_{DS2} \tag{4}$$

In order that both output transistors of the cascode mirror maintain operation in the saturation region, i.e., with sufficiently large $V_{DS2}$ and $V_{DS4}$, the minimum allowable $V_{outcascode}$ of the cascode mirror will be greater than the corresponding $V_{outsimple}$ of the simple mirror; hence, the output signal swing of the cascode mirror is reduced relative to that of the simple mirror.

This disadvantage of a reduced output voltage swing for the cascode mirror is further compounded by the unnecessarily high gate voltage ($V_{G3}$) on transistor M3, which leads to an unnecessarily high drain-to-source voltage ($V_{DS2}$) on M2. For illustrative purposes, assume all transistors in FIG. 2 are operating in the saturation region (i.e., that $V_{DSi} \geqq V_{GSi}-V_{Ti}$), are identically sized, have identical process parameters $\mu$, $C_{ox}$, and $V_T$, and behave according to the square-law model $$I_D=\frac{\mu Cox}{2}\ \frac{W}{L}\ (V_{GS}-V_T)^2 \tag{5}$$

It follows that $$V_{DS1}=V_{GS1}=\sqrt{\frac{2I_D}{\mu Cox}\ \frac{L}{W}}+V_{T1} \tag{6}$$

Note from (6) that, for $V_{T1} \geqq 0$, $V_{DS1}$ is a quantity $V_{T1}$ greater than necessary to maintain operation of M1 in the saturation region; hence, $V_{G3}$ ($=V_{DS1}+V_{GS3}$) will also be a quantity $V_{T1}$ greater than necessary. Assuming $I_{out}=I_{in}$, it follows that $V_{GS4}=V_{GS3}$, and it is seen that $V_{DS2}$ is also a quantity $V_{T1}$ greater than necessary. The end result is that the minimum sum $V_{outcascode}=V_{DS2}+V_{DS4}$ for which both output transistors operate in saturation is greater than necessary.

The prior art current mirror of FIG. 3 employs additional circuitry to generate the voltage at the gate of the cascode devices M3 and M4. This gate voltage can be made to be significantly lower than the corresponding gate voltage in the self-biased mirror of FIG. 2, leading to significantly lower minimum values of $V_{DS2}$ and $V_{outcascode}$ for which operation of the output transistors M3 and M4 in the saturation region is maintained. Hence, the mirror of FIG. 3 maintains a high output resistance over an increased output voltage range.

The disadvantage of the mirror of FIG. 3 is the added circuit complexity required. Note that in addition to the extra device M5 required to separately generate the gate voltage for cascode devices M3 and M4, this mirror will first require additional devices to generate the second input current $I_{in2}$ as well as additional wiring to route this second input current. It is likely that this second input current will also result in an increased power dissipation for the overall circuit.

What is needed is a current mirror which maintains a high output resistance for an increased output voltage range and which generates all required gate voltages from a single input current. The present invention satisfies this need.

SUMMARY OF THE INVENTION

It is therefore an object of this invention to provide a current mirror which maintains a high output resistance for an increased output voltage range.

Another object of this invention is to provide a current mirror which is suitable for use in low supply voltage systems.

Another object of this invention is to provide a current mirror which largely avoids the circuit complexities and increased power dissipation associated with prior art high-output-swing current mirrors.

These and other objects of this invention are realized by including in the mirror input current path a voltage drop means which generates a voltage difference suitable for use as the voltage difference between the gates of the driving transistors and the cascode transistors. In a preferred embodiment, the voltage drop means consists of a diode connected such that the mirror input current flows in the forward diode direction and generates a voltage drop. Connections to the mirror transistors are made such that the difference between the gate voltage of the cascode transistors and the gate voltage of the driving transistors is equal to the diode forward voltage drop. Since the diode forward voltage drop is typically less than the drain-to-source voltage drop across a diode-connected MOSFET (e.g., M3 in FIG. 2), it follows that the gate voltage of the cascode transistors, the drain-to-source voltage of the output driving transistor, and the minimum voltage at the mirror output for which saturation region transistor operation is maintained are all reduced in this embodiment relative to a comparable prior art cascode mirror of the type shown in FIG. 2.

DETAILED DESCRIPTION OF THE INVENTION

Figure 4:
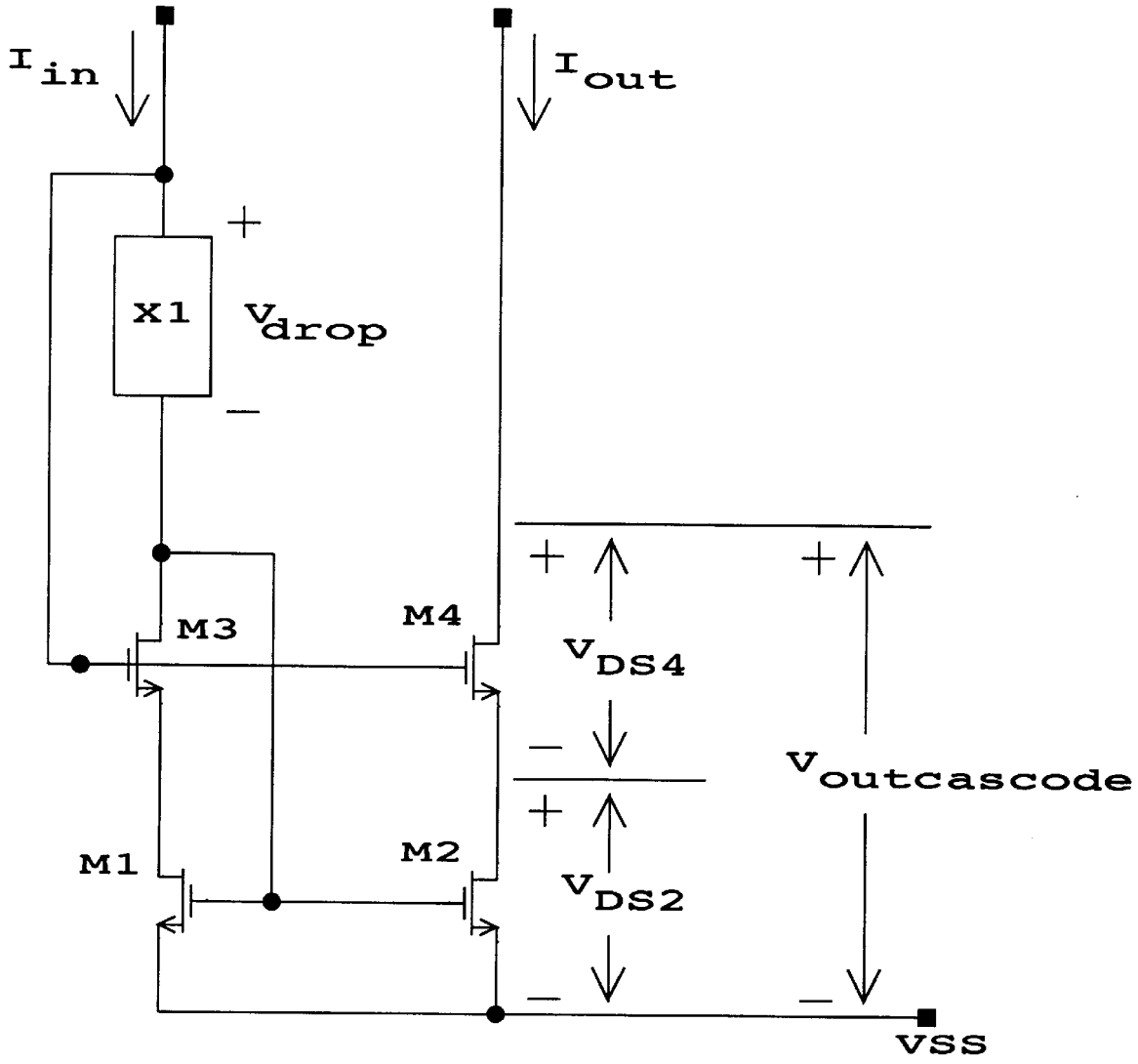
FIG. 4 is a schematic diagram of a high-output-swing cascode current mirror embodying the present invention, with a voltage drop means shown as a block X1.

FIG. 4 shows one embodiment of the present invention. It includes transistor pairs M1, M3 and M2, M4 in cascode arrangements and an element X1 across which there is a voltage drop $V_{drop}$. For illustrative purposes, assume all transistors operate in saturation, are identically sized, have identical process parameters $\mu$, $C_{ax}$, and $V_T$, and behave according to the square-law model of (5). Since $V_{GS1}=V_{GS2}$, it follows that $I_{out}=I_{in}$. Note that since the same drain current flows through both M4 and M2 (i.e., $I_{out}=I_{DS4}=I_{DS2}$), the corresponding gate-to-source voltages are equal (i.e., $V_{GS4}=V_{GS2}$). Hence, if the voltage at the gate of M4 is made to be a quantity $V_{drop}$ greater than the voltage at the gate of M2, then the source voltage of M4 ($V_{S4}=V_{DS2}$) will be a quantity $V_{drop}$ greater than the source voltage of M2. The output voltage may then be described as $$V_{out}=V_{drop}+V_{DS4} \tag{7}$$

Figure 2:
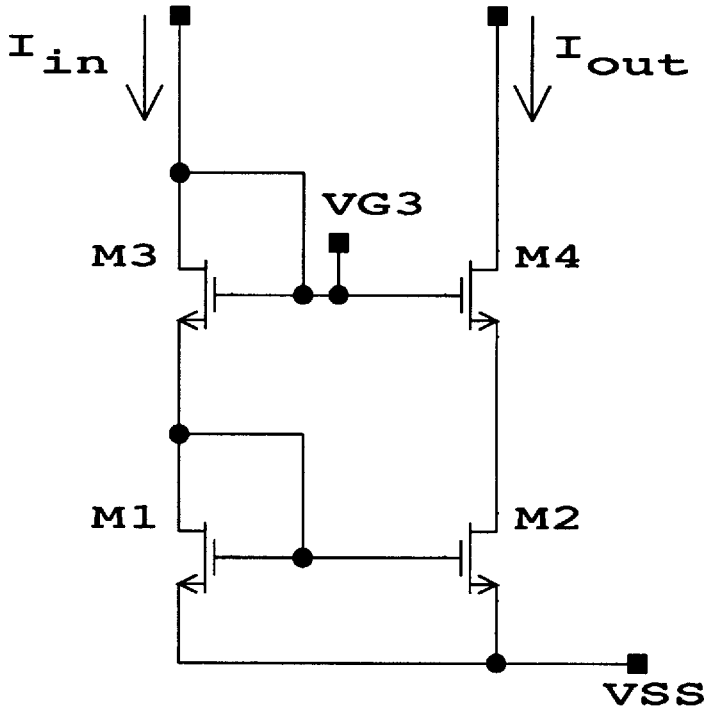
Fig. 2 PRIOR ART
FIG. 2 is a schematic diagram of a cascode current mirror as known in the prior art.

Note that if the quantity $V_{drop}$ can be made such that $$\sqrt{\frac{2I_{out}}{\mu Cox}\ \frac{L}{W}} < V_{drop} < \sqrt{\frac{2I_{out}}{\mu Cox}\ \frac{L}{W}} + V_T \tag{8}$$

then the saturation region operation of M2 is maintained for a smaller minimum output voltage ($V_{outmin}=V_{drop}+V_{DS4min}$) than was the case for the prior art cascode mirror of FIG. 2; i.e., in the present invention, a high output impedance is maintained for a larger output voltage range as compared to the prior art cascode mirror of FIG. 2.

Figure 3:
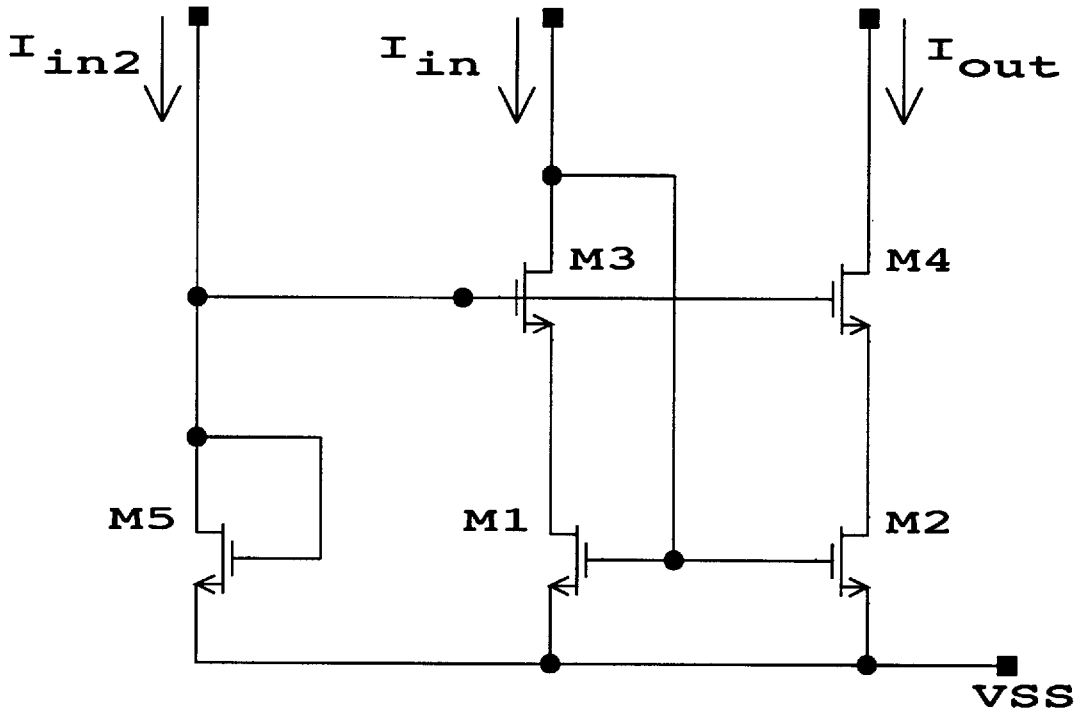
Fig. 3 PRIOR ART
FIG. 3 is a schematic diagram of a high-output-swing cascode current mirror as known in the prior art.

The desired quantity $V_{drop}$ is obtained in the present invention by the inclusion of a voltage drop means (element X1) in the input current path. Note that the connections shown result in the gate voltage $V_{G3}$ being a quantity $V_{drop}$ greater than the gate voltage $V_{G1}$; i.e., $$V_{G3}=V_{G1}+V_{drop} \tag{9}$$

as desired. Also note that, unlike the prior art mirror of FIG. 3, the present invention does not require an additional input current and associated complexities to generate this voltage $V_{G3}$, although the present invention is slightly more complex than the cascode mirror of FIG. 2.

One skilled in the art will recognize that if the bulk and source nodes of transistor M3 and of transistor M4 in FIG. 4 are not connected, then these transistors will exhibit a higher threshold voltage due to the body effect. To compensate for this effect, the voltage drop across element X1 in FIG. 4 can be made slightly higher than the desired voltage $V_{DS2}$. Similarly, if all transistors are not equally sized, it may be necessary to increase or decrease the voltage drop across element X1 in order to obtain a desired voltage $V_{DS2}$.

Figure 5:
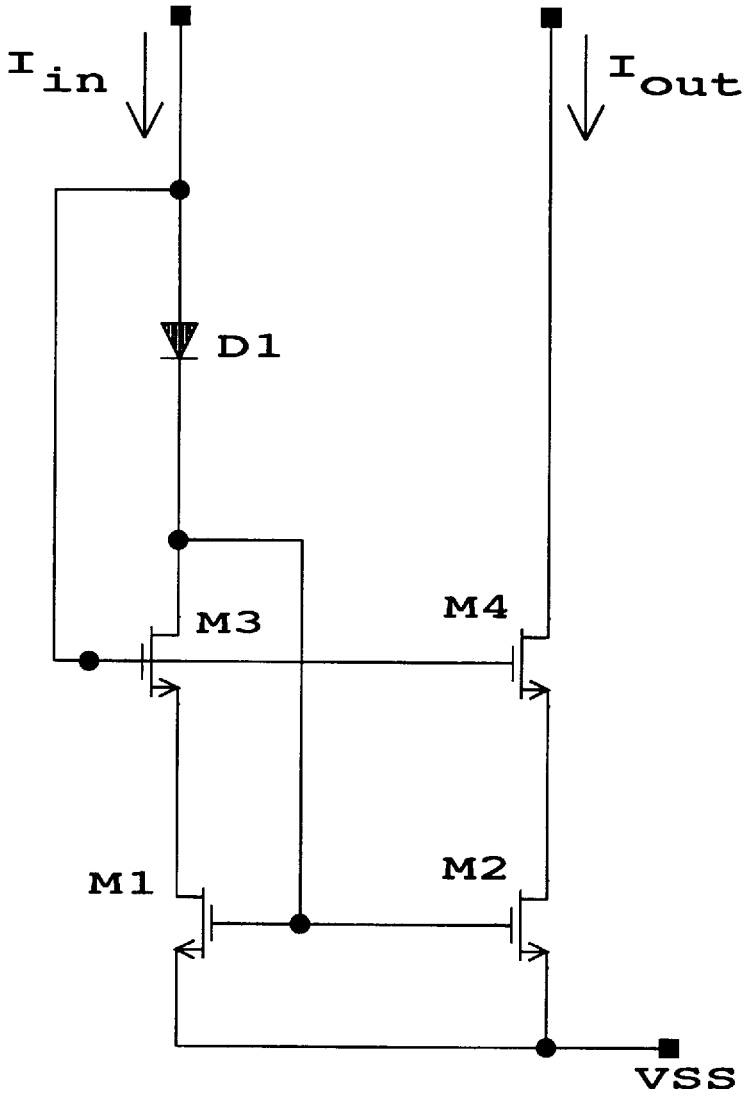
FIG. 5 is a schematic diagram of a high-output-swing cascode current mirror embodying the present invention, with a diode shown as the voltage drop means.
Figure 6:
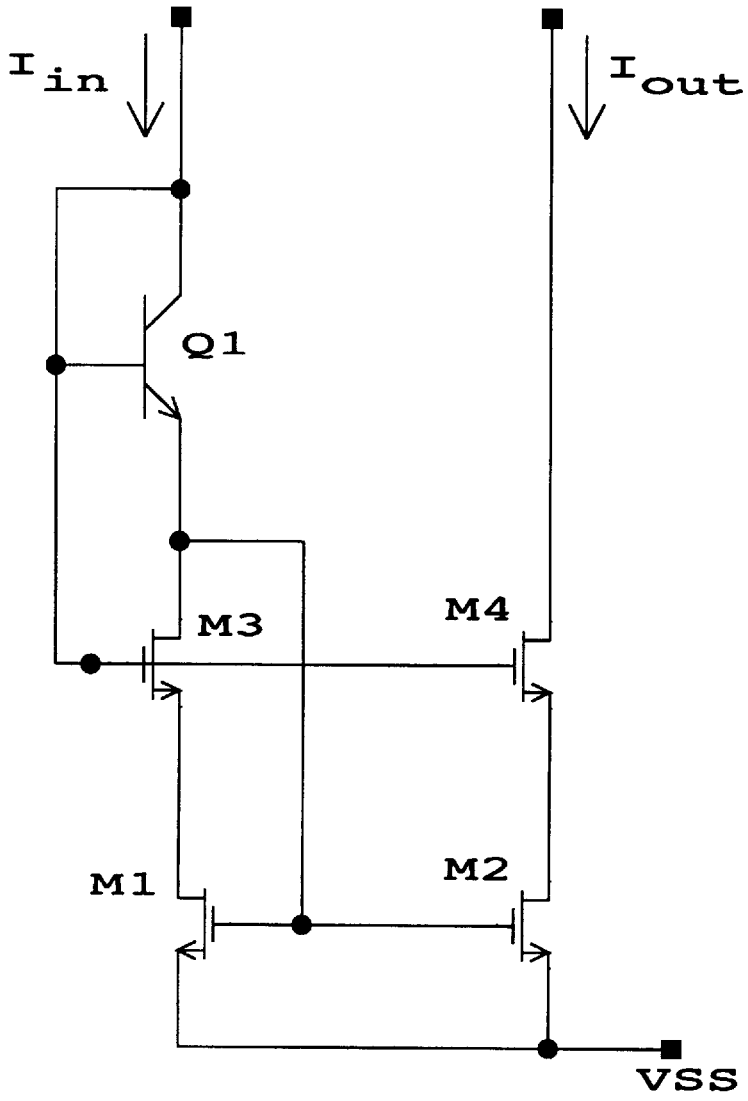
FIG. 6 is a schematic diagram of a high-output-swing cascode current mirror embodying the present invention, with a diode-connected bipolar junction transistor shown as the voltage drop means.

A number of practical means exist for generating the quantity $V_{drop}$. FIG. 5 shows an embodiment of the present invention in which $V_{drop}$ is generated by a diode. Since the diode forward voltage drop remains fairly constant over a wide range of diode current values, this embodiment is well suited to applications where the current mirror must function for a wide range of input current magnitudes. FIG. 6 shows an embodiment of the present invention in which a bipolar junction transistor is connected as a diode to generate the quantity $V_{drop}$.

Figure 7:
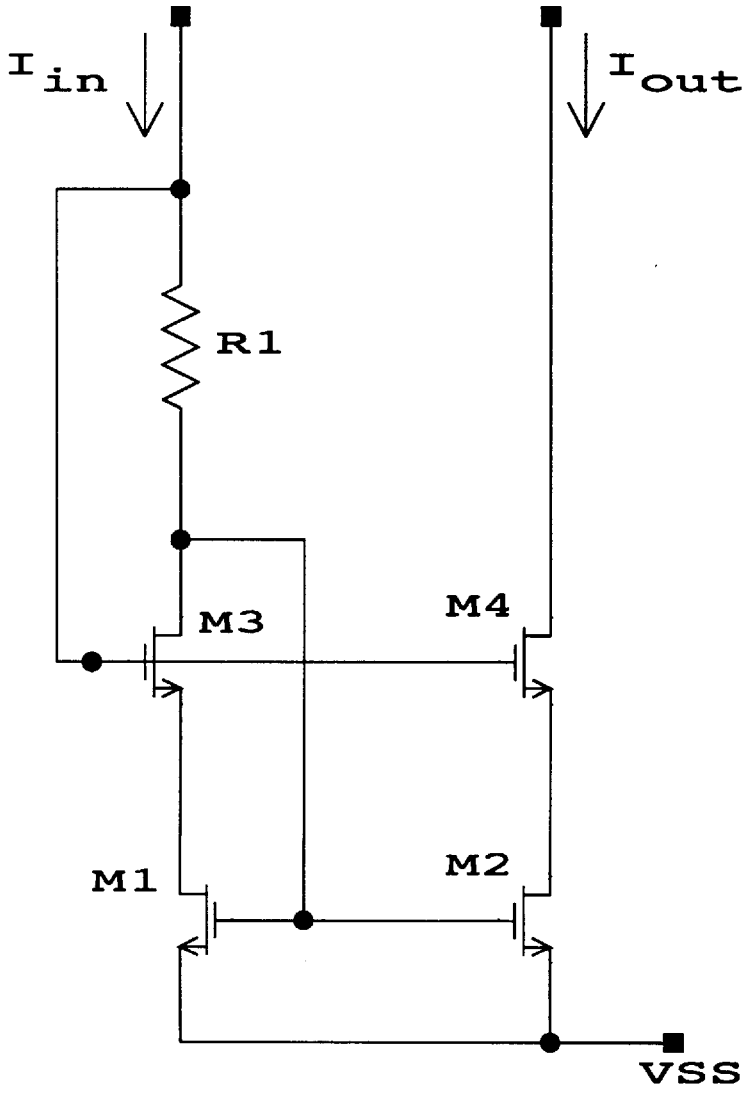
FIG. 7 is a schematic diagram of a high-output-swing cascode current mirror embodying the present invention, with a resistor shown as the voltage drop means.

FIG. 7 shows an embodiment of the present invention in which a resistive element is used to generate the quantity $V_{drop}$. This implementation is well suited to applications where the input current is referenced to a known voltage and a resistive element of the same type used to generate $V_{drop}$. For example, in integrated circuit design, bias currents are often generated from a constant reference voltage and an on-chip resistor, with the resistor being subject to fairly wide process and temperature variations. The bias current so generated may be expressed as $$I_{bias} = \frac{V_{ref}}{R_{bias}} \tag{10}$$

where $V_{ref}$ is the reference voltage and $R_{bias}$ is the resistor across which $V_{ref}$ is applied. If this bias current is the input current in the embodiment of FIG. 7, then the quantity $V_{drop}$ will be $$V_{drop} = V_{ref}\frac{R_{drop}}{R_{bias}} \tag{11}$$

Since $R_{drop}$ and $R_{bias}$ will be subject to approximately the same process and temperature variations, the ratio $R_{drop}/R_{bias}$ will be approximately constant, and $V_{drop}$ will be a function only of the reference voltage $V_{ref}$.

Figure 8:
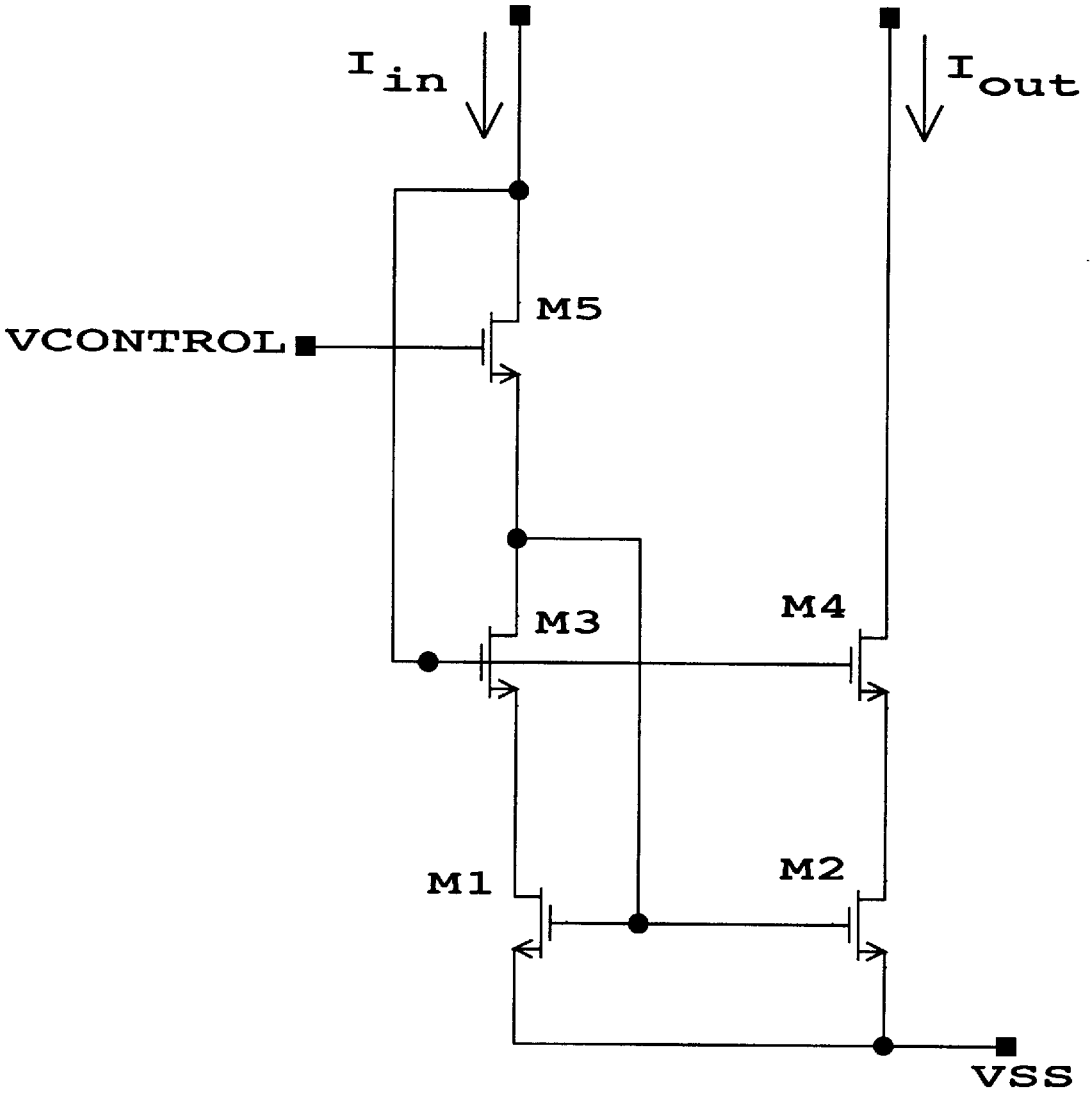
FIG. 8 is a schematic diagram of a high-output-swing cascode current mirror embodying the present invention, with a MOSFET shown as the voltage drop means.

FIG. 8 shows an embodiment of the present invention in which the quantity $V_{drop}$ is generated from a field-effect transistor (M5) with an externally-supplied gate voltage $V_{control}$. The external control voltage can be used to vary the $I_D$–$V_{DS}$ characteristic of M5 and hence to vary the quantity $V_{drop}$.

Figure 1:
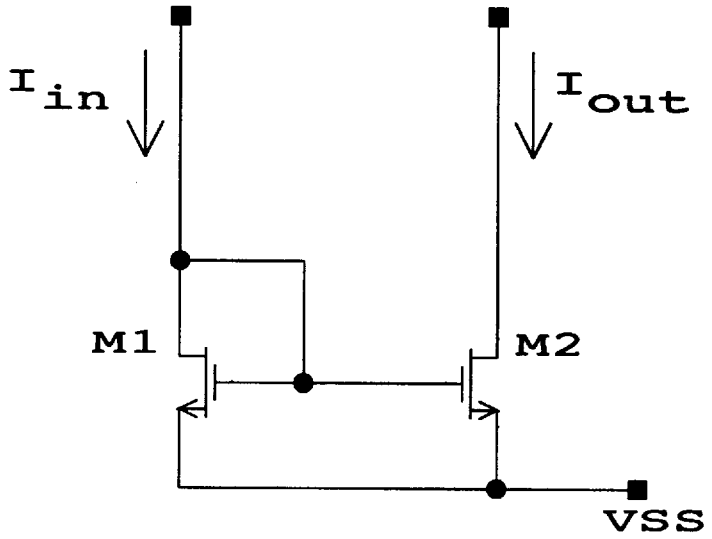
Fig. 1 PRIOR ART
FIG. 1 is a schematic diagram of a simple current mirror as known in the prior art.
Figure 9:
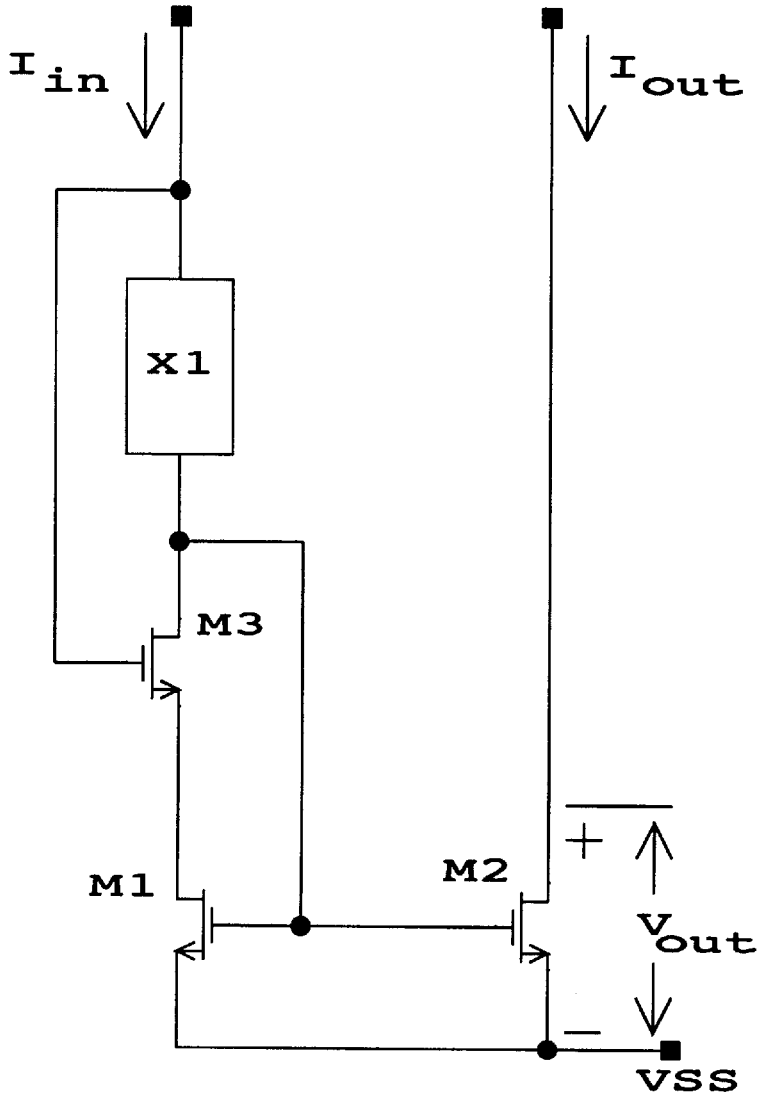
FIG. 9 is a schematic diagram of a current mirror embodying the present invention which does not include a cascode transistor in the mirror output circuit.

FIG. 9 shows an embodiment of the present invention in which the output cascode device has been omitted. One skilled in the art will note that the output resistance of this embodiment is comparable to that of the simple mirror of FIG. 1; i.e., this embodiment does not share the extremely high output resistance characteristic of the embodiments shown in FIGS. 4–8. However, relative to the simple mirror of FIG. 1, the embodiment of FIG. 9 can be made to exhibit a superior current transfer ratio accuracy for a smaller output voltage. This superior accuracy follows from the fact that, for the embodiment of FIG. 9, the mirror input circuit (X1, M1, M3) can be designed such that $V_{DS1} \approx V_{DS2} (= V_{out})$ for $V_{DS1} < V_{GS1}$, whereas the simple mirror of FIG. 1 is constrained by $V_{DS1} = V_{GS1}$.

Figure 10:
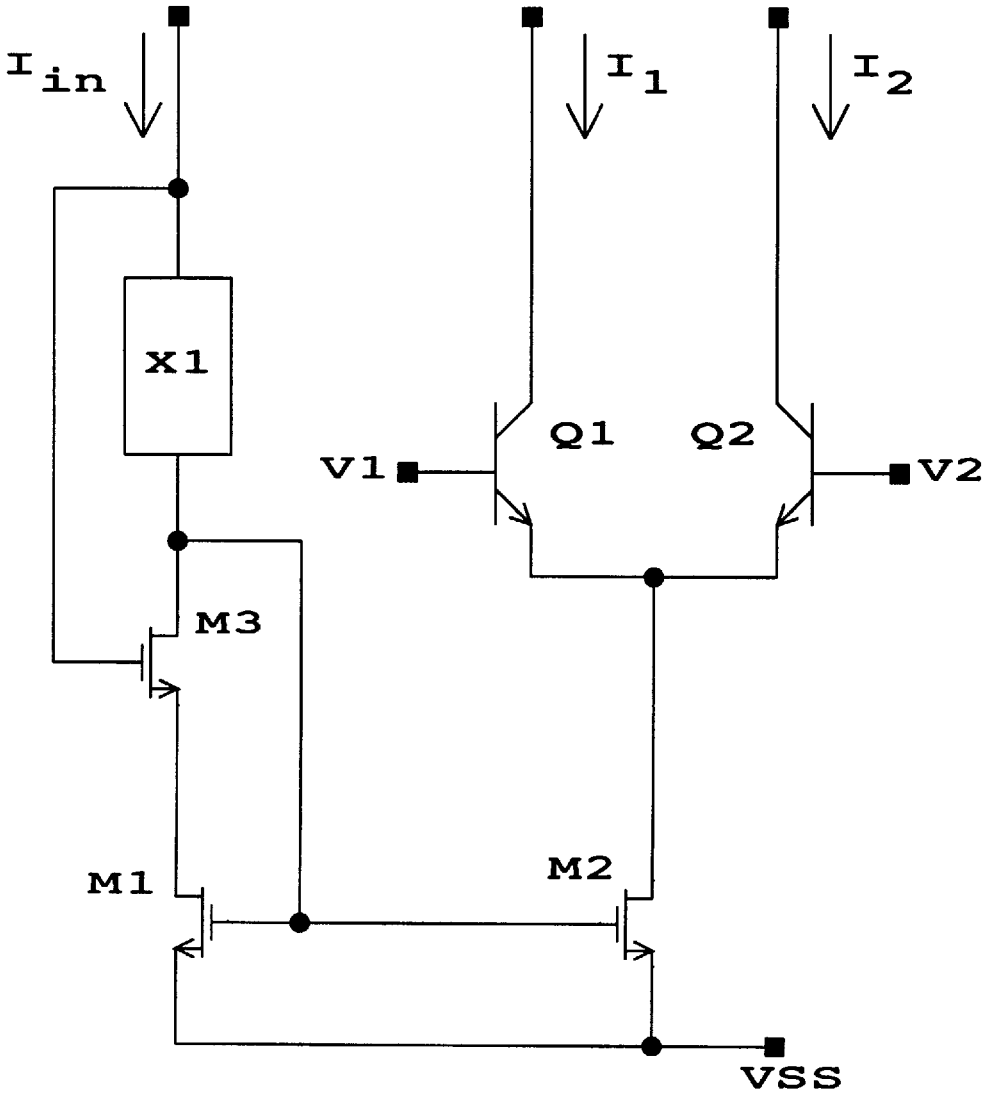
FIG. 10 is a schematic diagram of a differential pair circuit biased by a current mirror embodying the present invention, illustrating a practical application of the embodiment of FIG. 9.

FIG. 10 illustrates a practical application of the embodiment of FIG. 9; the mirror consisting of D1, M1, M2, and M3 is used to provide the bias current for the differential pair consisting of Q1 and Q2. For illustrative purposes, assume M1, M2, and M3 are operating in the saturation region, are identically sized, have identical process parameters $\mu$, $C_{ox}$, and $V_T$ and behave according to the square-law model of (5) for the case where channel-length modulation effects are neglected and behave according to the model $$I_D = \frac{\mu Cox}{2} \quad \frac{W}{L} \; (V_{GS} - V_T)^2(1 + \lambda V_{DS}) \tag{10}$$

for the case where channel-length modulation effects are included and where $\lambda$ is the channel-length modulation factor. Also assume that the bipolar junction transistors Q1 and Q2 are matched and that the voltage inputs V1 and V2 are fully differential with a common-mode voltage $V_{CM}$. Since the same drain current flows through M1 and M3, it follows from (5) that these devices will have approximately equal gate-to-source voltages, and, since the gate of M3 is biased at one diode forward voltage drop ($V_{diode}$) above the gate of M1, is follows that the source of M3 will be biased at approximately $V_{diode}$ above the source of M1, i.e., that $V_{DS1} \approx V_{diode}$. If the common-mode voltage $V_{CM}$ is chosen to be the sum of $V_{diode}$ and the quiescent base-emitter forward voltage drop ($V_{BE}$) of Q1, Q2, then the quiescent drain-to-source voltage across M2 will be $V_{DS2} \approx V_{CM} - V_{BE} = V_{diode}$. Since M1 and M2 thus will have the same $V_{GS}$ and approximately the same $V_{DS}$, according to the model of (10) a very accurate current transfer ratio will result.

Also noteworthy in the example of FIG. 10 is that the relatively small variations in the differential-mode input signal (V1–V2) often necessitated by the use of the bipolar differential pair as a linear amplifier lead to yet smaller variations in the voltage at the common emitter node of the differential pair. In such cases where the mirror output node is subject only to small voltage variations, the need for an extremely high mirror output resistance often becomes less critical, and the embodiment of FIG. 9, with its lower output resistance relative to the embodiments of FIGS. 4–8, will often be satisfactory.

Figure 11:
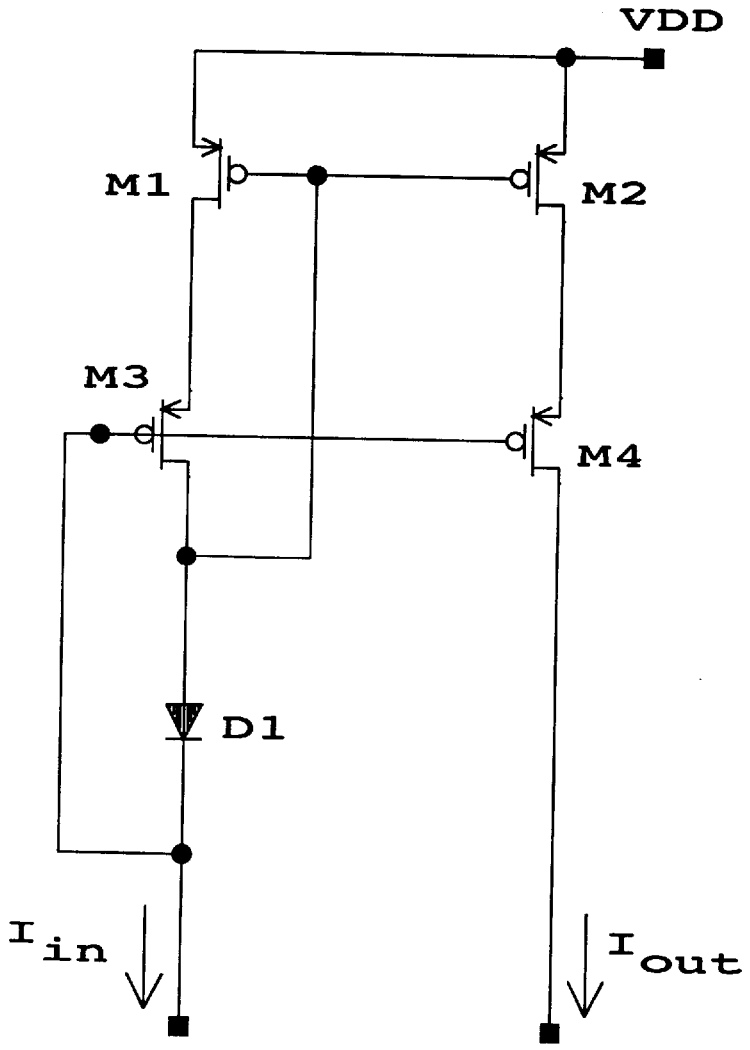
FIG. 11 is a schematic diagram of a high-output-swing cascode current mirror embodying the present invention, with p-channel MOSFETs and with a diode shown as the voltage drop means.

While the preceding embodiments of the present invention have been described using enhancement-mode n-channel metal-oxide-semiconductor field-effect transistors, one skilled in the art will recognize that the invention can also be implemented with other types of field-effect transistors. For example, FIG. 11 shows an embodiment of the present invention which uses p-channel field effect transistors and a diode to generate the desired voltage drop.

One skilled in the art will recognize that there exist a number of other embodiments of the present invention which realize a high output resistance over an increased output voltage range. In particular, there exist a number of means to generate the required voltage drop in the input current circuit. I claim all embodiments falling within the scope and spirit of the present invention.

I claim:

1. A current mirror circuit comprising:

first, second, third, and fourth field-effect transistors, means for connecting the gate of said first field-effect transistor (FET) to the gate of said second FET and to the drain of said third FET;

means for connecting the drain of said first FET to the source of said third FET;

means for connecting the drain of said second FET to the source of said fourth FET;

means for connecting the gate of said third FET to the gate of said fourth FET and to an input current means;

means for connecting the drain of said fourth FET to an output current means;

a voltage difference means for obtaining a voltage difference between a first and second terminal by directing a current into said first terminal;

means for connecting said input current means to said first terminal of said voltage difference means;

means for connecting the drain of said third FET to the second terminal of said voltage difference means.

2. A current mirror circuit in accordance with claim 1 wherein said voltage difference means comprises a diode.

3. A current mirror circuit in accordance with claim 1 wherein said voltage difference means comprises a bipolar junction transistor.

4. A current mirror circuit in accordance with claim 1 wherein said voltage difference means comprises a resistive element.

5. A current mirror circuit in accordance with claim 1 wherein said voltage difference means comprises a FET.

6. A current mirror circuit comprising:

first, second, and third field-effect transistors;

means for connecting the gate of said first field-effect transistor (FET) to the gate of said second FET and to the drain of said third FET;

means for connecting the drain of said first FET to the source of said third FET;

means for connecting the gate of said third FET to an input current means;

means for connecting the drain of said second FET to an output current means;

a voltage difference means for obtaining a voltage difference between a first and second terminal by directing a current into said first terminal;

means for connecting said input current means to said first terminal of said voltage difference means;

means for connecting the drain of said third FET to the second terminal of said voltage difference means.

7. A current mirror circuit in accordance with claim 6 wherein said voltage difference means comprises a diode.

8. A current mirror circuit in accordance with claim 6 wherein said voltage difference means comprises a bipolar junction transistor.

9. A current mirror circuit in accordance with claim 6 wherein said voltage difference means comprises a resistive element.

10. A current mirror circuit in accordance with claim 6 wherein said voltage difference means comprises a FET.

* * * * *